US011777255B1

(12) United States Patent
Choi

(10) Patent No.: US 11,777,255 B1
(45) Date of Patent: Oct. 3, 2023

(54) POWER DISTRIBUTION UNIT, POWER OUTLET MODULES WITH SECURE SOCKET-AND-PLUG CONNECTION

(71) Applicant: Austin Hughes Electronics Ltd, Hong Kong (HK)

(72) Inventor: Man Hin Choi, Hong Kong (HK)

(73) Assignee: Austin Hughes Electronics Ltd, Hong Kong (HK)

( * ) Notice: Subject to any disclaimer, the term of this patent is extended or adjusted under 35 U.S.C. 154(b) by 0 days.

(21) Appl. No.: 18/138,756

(22) Filed: Apr. 25, 2023

(51) Int. Cl.

| | |
|---|---|
| ***H01R 13/639*** | (2006.01) |
| ***H01R 24/78*** | (2011.01) |
| ***H01R 13/35*** | (2006.01) |
| ***H01R 24/30*** | (2011.01) |
| ***H01R 13/58*** | (2006.01) |
| ***H01R 13/635*** | (2006.01) |
| *H01R 103/00* | (2006.01) |

(52) U.S. Cl.
CPC ..... *H01R 13/6395* (2013.01); *H01R 13/35* (2013.01); *H01R 13/5825* (2013.01); *H01R 13/5829* (2013.01); *H01R 13/635* (2013.01); *H01R 24/30* (2013.01); *H01R 24/78* (2013.01); *H01R 2103/00* (2013.01)

(58) Field of Classification Search
CPC .. H01R 13/6395; H01R 13/639; H01R 13/35; H01R 13/10; H01R 13/04; H01R 13/02; H01R 13/5825; H01R 13/5829; H01R 13/635; H01R 24/30; H01R 24/78; H01R 2103/00; H01R 2105/00
See application file for complete search history.

(56) References Cited

U.S. PATENT DOCUMENTS

| | | | | |
|---|---|---|---|---|
| 5,702,259 | A * | 12/1997 | Lee | H01R 13/4534 439/518 |
| 6,776,630 | B1 * | 8/2004 | Huang | H01R 13/4534 439/145 |
| 7,914,307 | B1 * | 3/2011 | Yang | H01R 13/4534 439/145 |
| 9,312,625 | B2 * | 4/2016 | Shen | H01R 13/4534 |
| 9,548,574 | B2 * | 1/2017 | Hsu | H01R 13/7038 |
| 9,843,146 | B1 * | 12/2017 | Chen | H01R 13/514 |
| 10,541,501 | B2 | 1/2020 | Hutchison et al. | |
| 10,680,398 | B1 | 6/2020 | Irons et al. | |
| 11,276,970 | B1 * | 3/2022 | Dittus | H01R 27/00 |
| 11,283,224 | B1 * | 3/2022 | Wang | H01R 24/66 |
| 11,563,296 | B2 * | 1/2023 | Swift | H01R 13/645 |
| 2013/0316589 | A1 * | 11/2013 | Lee | H01R 27/02 439/653 |

FOREIGN PATENT DOCUMENTS

CN 201820962 U 5/2011

* cited by examiner

*Primary Examiner* — Harshad C Patel

(57) ABSTRACT

A power distribution unit includes a housing; a plurality of power outlet modules accommodated in the housing, at least one of the power outlet modules including a socket having at least three electrical terminals which are configured to connect with one power cord plug of various types of power cord plugs, including a C14 plug and a C20 plug, and a sliding cover having a central opening, the sliding cover being slidable on an outer casing of the socket and engageable with the power cord plug when the power cord plug is completely inserted into the socket, thereby providing a secure connection between the socket and the power cord plug; and at least one power input module providing power to the power outlet modules.

17 Claims, 20 Drawing Sheets

POWER DISTRIBUTION UNIT, POWER OUTLET MODULES WITH SECURE SOCKET-AND-PLUG CONNECTION

TECHNICAL FIELD

The present disclosure relates to a power distribution unit and power outlet modules with secure socket-and-plug connection.

BACKGROUND TECHNOLOGY

The design and construction of electrical sockets and plugs are well known in the art. This includes a socket with electrical terminals for connection with different types of plugs, and a plug that can be securely connected to the socket. One disadvantage of these sockets and plugs is that the plugs connected to the socket can be unintentionally disconnected when a pulling force acts on the plug in a direction away from the socket. Furthermore, the socket may be damaged or burnt. As a result, the whole socket needs to be replaced.

Many attempts have been made to solve the above problem. For example, in U.S. Pat. No. 10,541,501 granted to Vertiv Corporation, a receptacle housing includes a flange located at a base of the receptacle housing to provide a more secure fit between a plug and a receptacle. The structure of the receptacle and plug proposed in the patent is very complicated. This patent does not suggest the use of a simple structure such as a sliding cover slidable on top of a receptacle to secure a socket-and-plug connection.

U.S. Pat. No. 10,680,398 granted to Server Technology, Inc. discloses outlet connectors and a power distribution unit incorporating these outlet connectors. This patent also does not suggest the use of a sliding cover slidable on top of a socket to secure a socket-and-plug connection.

SUMMARY

According to one aspect, there is provided a power distribution unit, including: a housing; a plurality of power outlet modules accommodated in the housing, at least one of the plurality of power outlet modules including: a socket, the socket having at least three electrical terminals, the at least three electrical terminals being configured to connect with one power cord plug of various types of power cord plugs, the various types of power cord plugs including a C14 plug and a C20 plug, and a sliding cover having a central opening, the sliding cover being slidable on an outer casing of the socket, and engageable with the one power cord plug of various types of power cord plugs when the one power cord plug of various types of power cord plugs is completely inserted into the socket, thereby providing a secure connection between the socket and the one power cord plug of various types of power cord plugs; and at least one power input module connected with and providing power to the plurality of power outlet modules.

In one embodiment, a protruded lateral side is provided on a protective shield located at a free end of the one power cord plug of various types of power cord plugs.

In one embodiment, a spring mechanism is connecting between the sliding cover and the outer casing of the socket for holding the sliding cover in an initial position.

In one embodiment, the sliding cover is provided with an inwardly and downwardly slanting top surface, and the sliding cover is slidable from the initial position to a release position against a biasing force of the spring mechanism when the one power cord plug of various types of power cord plugs is being inserted into the socket, and the protruded lateral side is pressing on the slanting top surface.

In one embodiment, the sliding cover is provided with an inner periphery at the central opening, and the sliding cover is slidable under the influence of the spring force of the spring mechanism from the release position to an engaging position where the protruded lateral side is located under and engaged with the inner periphery of the sliding cover, after the one power cord plug of various types of power cord plugs is completely inserted into the socket, thereby preventing the one power cord plug of various types of power cord plugs from being pulled out of the socket or becoming loose.

In one embodiment, the sliding cover is adapted to be manually slidable by a user from the engaging position to the release position, thereby allowing the one power cord plug of various types of power cord plugs to be pulled out of the socket.

In one embodiment, the sliding cover is adapted to be automatically slidable from the release position to the initial position under the influence of the spring force of the spring mechanism after the one power cord plug of various types of power cord plugs is pulled out of the socket.

In one embodiment, each electrical terminal of the at least three electrical terminals is configured to connect with a pin of the C14 plug or a pin of the C20 plug.

In one embodiment, each electrical terminal of the at least three electrical terminals comprises a plurality of flexible conductive strips configured to hold and make electrical contact with a pin of the C14 plug or a pin of the C20 plug.

In one embodiment, the plurality of power outlet modules further includes at least one additional power outlet module comprising an additional socket configured to connect only with the C14 plug.

In one embodiment, the plurality of power outlet modules further includes at least one additional power outlet module comprising an additional socket configured to connect only with the C20 plug.

In one embodiment, the additional socket includes at least three electrical terminals, the at least three electrical terminals of the additional socket being configured to connect only with the C14 plug.

In one embodiment, the additional socket includes at least three electrical terminals, the at least three electrical terminals of the additional socket being configured to connect only with the C20 plug.

In one embodiment, a bottom portion of each of the at least three electrical terminals is connected and fastened to a power line by a screw.

In one embodiment, the bottom portions of the at least three electrical terminals are connected with an electronic board configured to detect power status of the at least three electrical terminals.

In one embodiment, the power outlet module further includes a display unit, the display unit including: a first light pipe mounted on the outer casing of the socket, the first light pipe having an inner end facing a light emitting diode mounted on the electronic board, and an outer end fitted within a first opening provided on the outer casing of the socket; and a second light pipe mounted on the sliding rectangular cover, the second light pipe having an inner end abutting against the outer end of the first light pipe, and an outer end fitted within a second opening provided on the sliding rectangular cover, the second light pipe being slidable on the outer end of the first light pipe when the sliding rectangular cover slides along the outer casing of the socket, whereby light emitting from the light emitting diode is transmittable to the outer end of the second light pipe through the first light pipe to display power status of the socket.

In one embodiment, the sliding covers have different colors.

In one embodiment, the sliding covers are rectangular in shape.

In one embodiment, the spring mechanism includes a flexible bow-shaped spring, a middle portion of the bow-shaped spring being fastened to an outer surface of one side of the outer casing of the socket by a fastener, and two flexible ends of the bow-shaped spring being abutted against an inner surface of a sidewall of the sliding rectangular cover.

According to another aspect, there is provided a power outlet module with secure socket-and-plug connection, the power outlet module including: a socket, the socket having at least three electrical terminals, the at least three electrical terminals being configured to connect with one power cord plug of various types of power cord plugs, the various types of power cord plugs including a C14 plug and a C20 plug; a sliding cover having a central opening, the sliding cover being slidable on an outer casing of the socket, two elongated grooves being provided on two opposite sides of the sliding cover and in slidable engagement with two matching elongated projections provided on two opposite sides of the outer casing of the socket respectively; and a spring mechanism connecting between the sliding cover and the outer casing of the socket, wherein an inner periphery of the sliding cover is engageable with a protruded lateral side provided on a protective shield located at a free end of the one power cord plug of various types of power cord plugs when the one power cord plug of various types of power cord plugs is completely inserted into the socket, thereby providing a secure connection between the socket and the one power cord plug of various types of power cord plugs.

BRIEF DESCRIPTION OF THE DRAWINGS

Specific embodiments of the present disclosure will now be described by way of example with reference to the accompanying drawings wherein.

DETAILED DESCRIPTION

Figure 1:
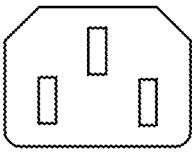
FIG. 1 is a front view of a C14 plug according to an embodiment of the present disclosure.

Before any embodiments of the present disclosure are explained in detail, it is to be understood that the embodiments may not be limited to the details of the structure or function set forth in the following description or shown in the accompanying drawings. Different embodiments may be capable of being practiced or carried out in various ways. Further, it is to be understood that the phraseology and terminology used herein are for the purpose of description and should not be regarded as limiting. Use of the terms such as "comprising," "including" or "having" and variations thereof herein is generally intended to encompass the items listed thereafter and equivalents thereof as well as additional items. Also, unless otherwise stated, technical terms are used according to conventional usage. It is further contemplated that like reference numerals may describe like components and their equivalents.

Furthermore, it should be noted that throughout the specification and claims herein, when one element is said to be "connected" to another, this does not necessarily mean that one element is fastened, secured, or otherwise attached to another element. Instead, the term "connected" means that one element is either connected directly or indirectly to another element or is in mechanical or electrical communication with another element.

Figure 2:
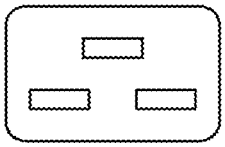
FIG. 2 is a front view of a C20 plug according to an embodiment of the present disclosure.

FIG. 1 shows a front view of a power cord C14 plug according to an embodiment of the present disclosure, and FIG. 2 shows a front view of a power cord C20 plug according to an embodiment of the present disclosure. C14 plugs and C20 plugs refer to two different standard male connectors according to the IEC60320 standard, commonly used in computing equipment, servers, network equipment, etc.

Figure 3:
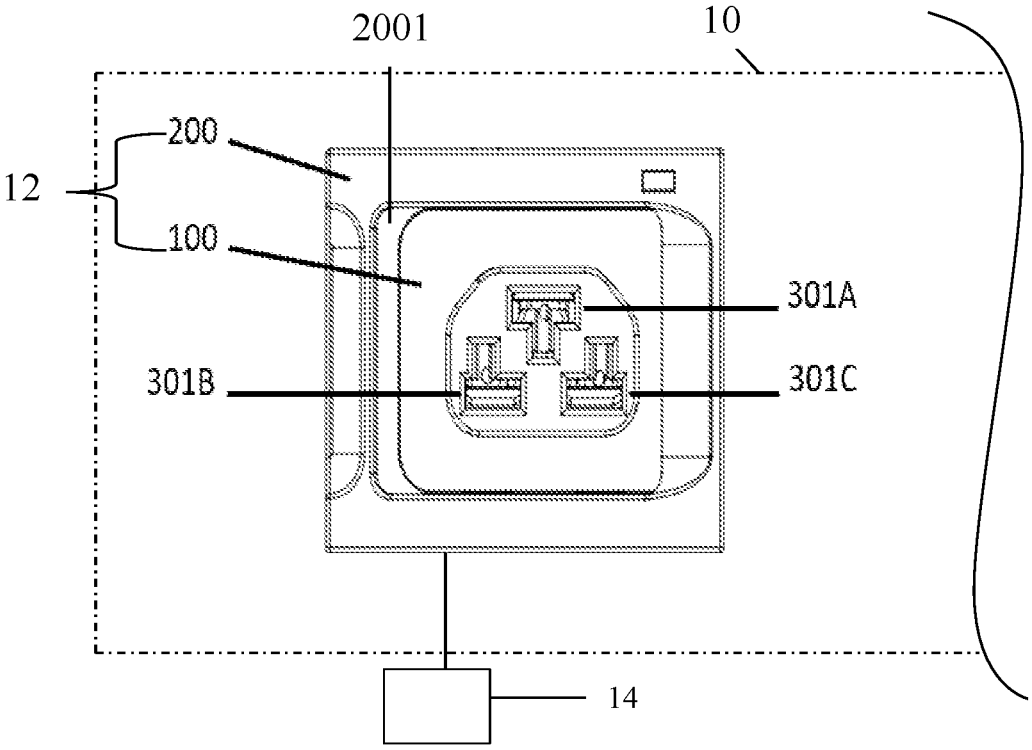
FIG. 3 is a front view of a power outlet module configured to connect to a C14 plug or a C20 plug of a power cord according to an embodiment of the present disclosure.

FIG. 3 is a front view of a power outlet module configured to connect to a C14 plug or a C20 plug of a power cord according to an embodiment of the present disclosure. A power distribution unit may include a housing 10 and a plurality of power outlet modules 12 mounted in the housing 10. At least one of the plurality of power outlet modules 12 may include a socket 100 and a sliding rectangular cover 200 slidably connected with the socket 100.

The socket 100 may have at least three electrical terminals 301A, 301B, 301C. The at least three electrical terminals 301A, 301B, 301C of the socket 100 can be configured to connect with one power cord plug C14, C20 of various types of power cord plugs. The various types of power cord plugs may include a C14 plug and a C20 plug.

The sliding rectangular cover 200 may have a central opening 2001. The sliding rectangular cover 200 can be slidable on an outer casing 1001 of the socket 100, and engageable with the one power cord plug C14, C20 of various types of power cord plugs when the one power cord plug C14, C20 of various types of power cord plugs is completely inserted into the socket 100. This engagement can provide a secure connection between the socket 100 and the one power cord plug C14, C20 of various types of power cord plugs.

The power distribution may include at least one power input module 14. The power input module 14 may be connected with the plurality of power outlet modules 12, and serve to provide power to the plurality of power outlet modules 12.

Although it has been shown and described that the sliding rectangular cover 200 is rectangular in shape, it is understood that the sliding cover 200 may have a different shape. Furthermore, the sliding rectangular covers 200 may have different colors.

Figure 4:
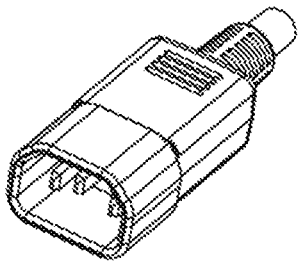
FIG. 4 is a perspective view of a C14 plug according to an embodiment of the present disclosure.
Figure 5:
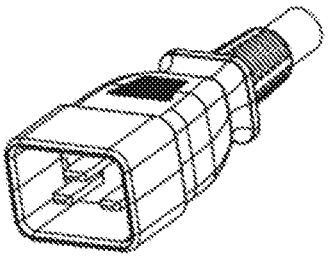
FIG. 5 is a perspective view of a C20 plug according to an embodiment of the present disclosure.

FIG. 4 shows a perspective view of a C14 plug according to an embodiment of the present disclosure, and FIG. 5 shows a perspective view of a C20 plug according to an embodiment of the present disclosure. A protruded lateral side 110 (see FIG. 7) may be provided on a protective shield located at a free end of the one power cord plug C14, C20 of various types of power cord plugs.

Figure 6:
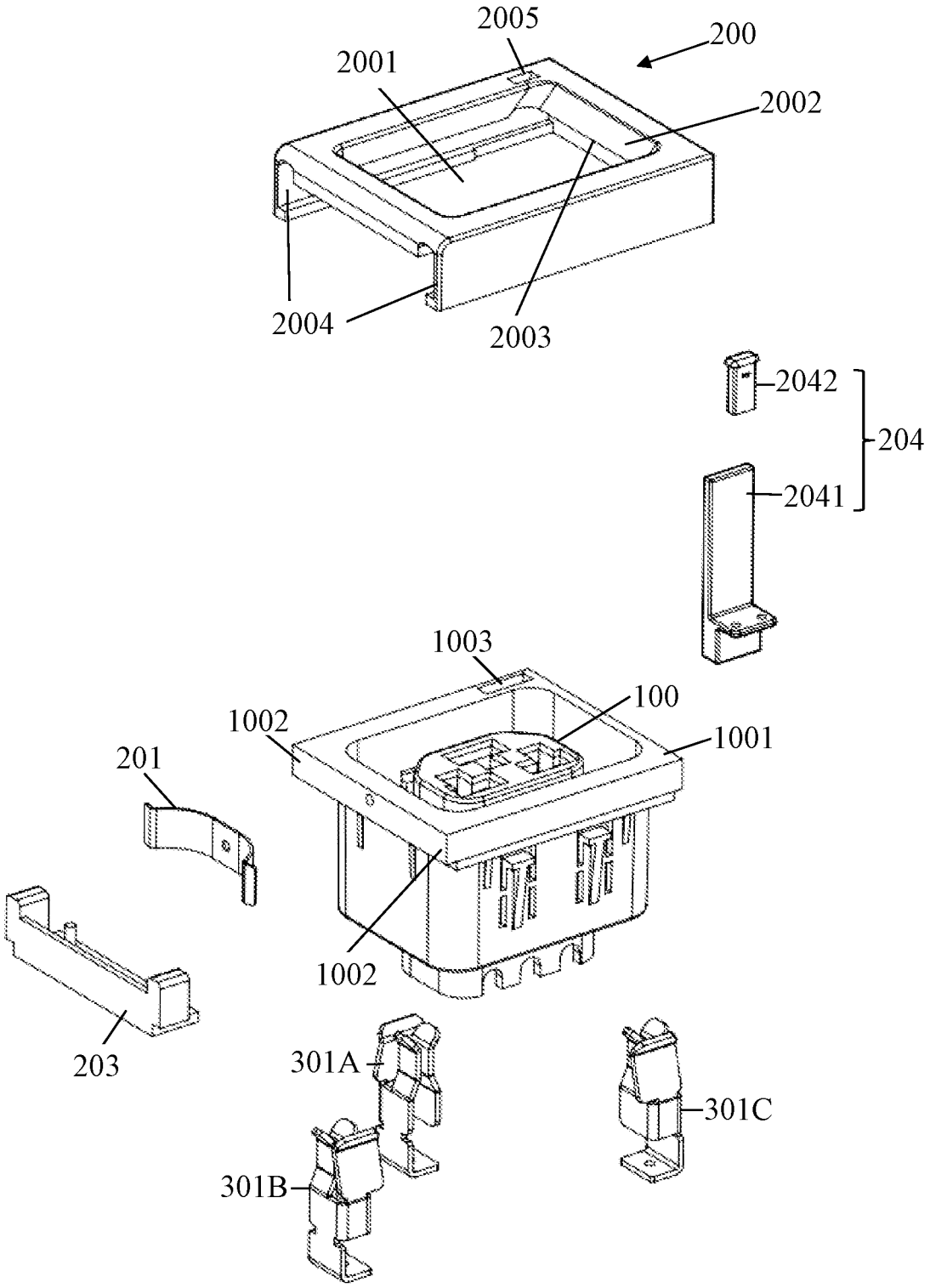
FIG. 6 is an exploded view of the power outlet module of FIG. 3 according to an embodiment of the present disclosure.
Figure 7:
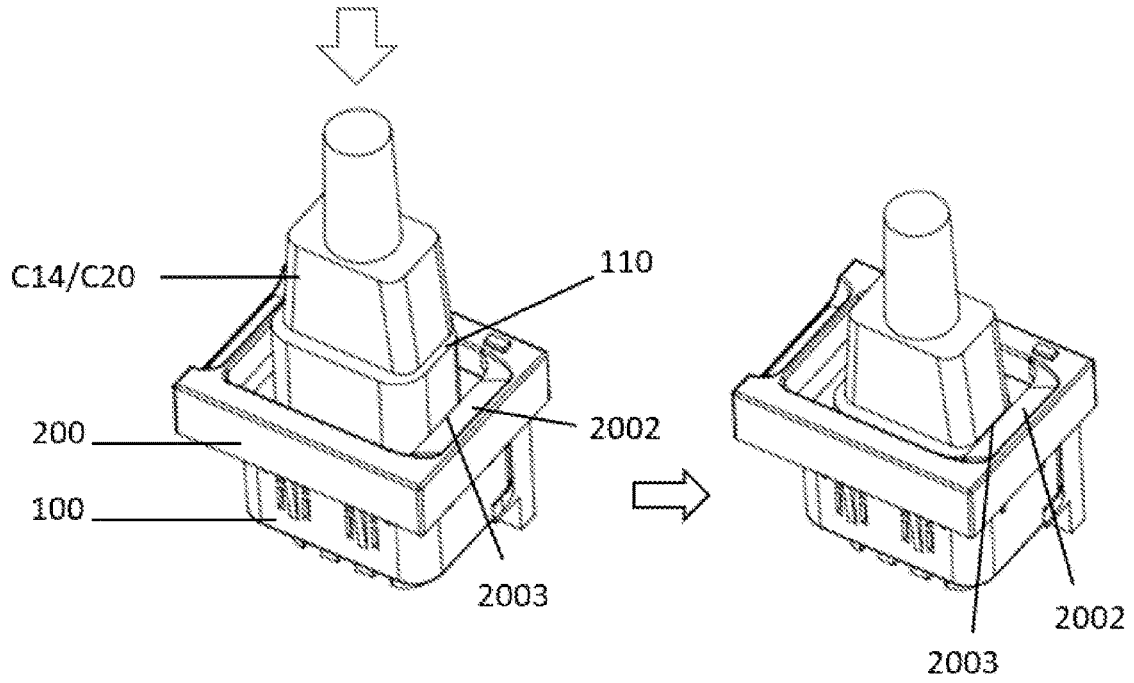
FIG. 7 shows that the C14/C20 plug includes a protruded lateral side engageable with an inner periphery of a sliding rectangular cover in accordance with an embodiment of the present disclosure.

FIG. 6 is an exploded view of the power outlet module 12 according to an embodiment of the present disclosure, and FIG. 7 shows that the protruded lateral side 110 of the C14/C20 plug is engageable with an inner periphery of the sliding rectangular cover 200 in accordance with an embodiment of the present disclosure.

In one embodiment, two elongated grooves 2004 may be formed on two opposite sides of the sliding rectangular cover 200, which are in slidable engagement with two matching elongated projections 1002 formed on two opposite sides of the front face of the outer casing 1001 of the socket 100 respectively.

In one embodiment, a spring mechanism 201 may be connected between the sliding rectangular cover 200 and the outer casing 1001 of the socket 100 for holding the sliding rectangular cover 200 in an initial position. In the illustrated embodiment, the spring mechanism may include a flexible bow-shaped spring 201. It is understood by a person skilled in the art that other suitable spring mechanism, such as tension springs, may be used.

Figure 13A:
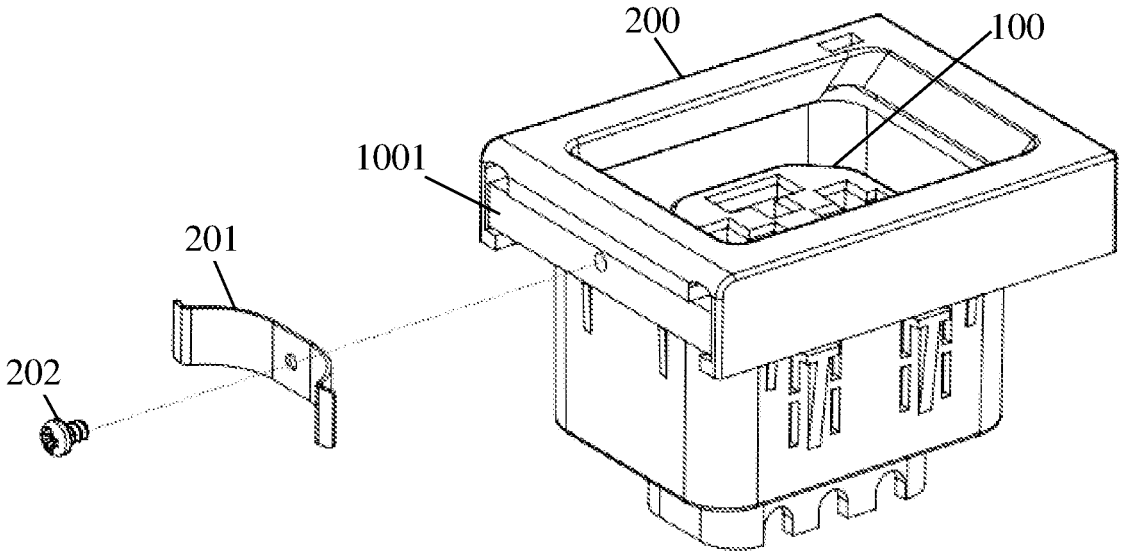
FIG. 13*a* is a perspective view showing the connection of a bow-shaped spring to an outer casing of the socket according to an embodiment of the present disclosure.
Figure 14A:
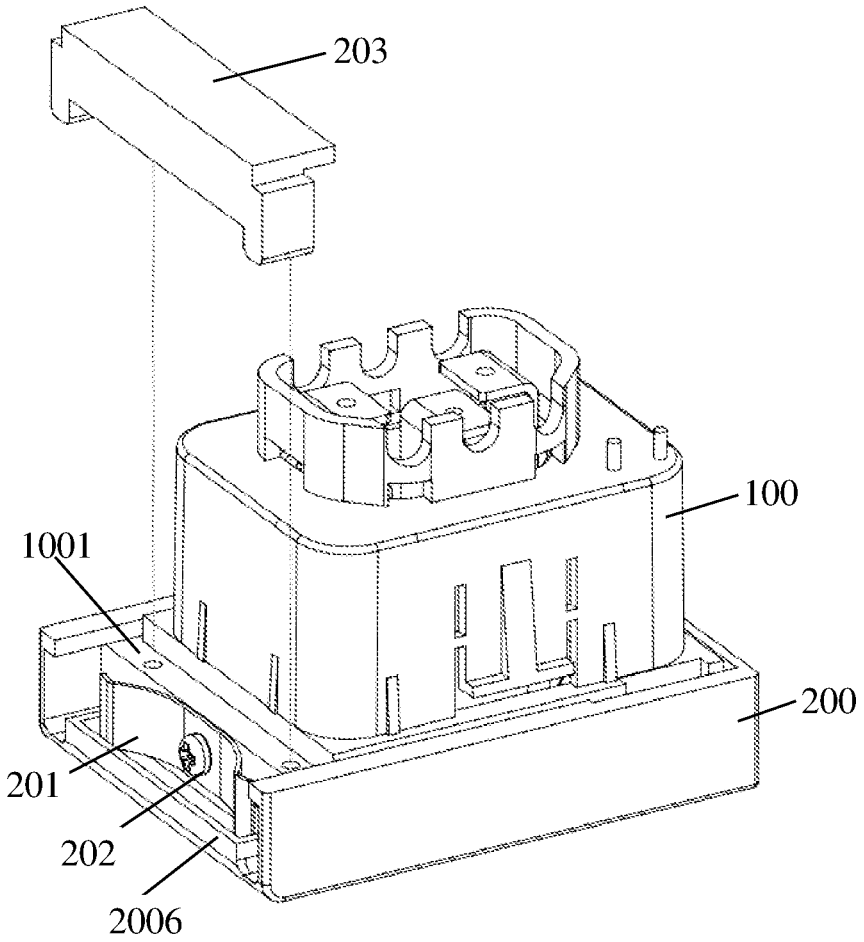
FIG. 14*a* is a perspective view showing the connection of a cover to an outer casing of the socket according to an embodiment of the present disclosure.

In one embodiment, a middle portion of the flexible bow-shaped spring 201 can be fastened to an outer surface of one side of the outer casing 1001 of the socket 100 by a fastener 202, such as a screw, as illustrated in FIG. 13*a*. Two flexible ends of the flexible bow-shaped spring 201 may be abutted against an inner surface of a sidewall 2006 of the sliding rectangular cover 200, as shown in FIG. 14*a*.

The sliding rectangular cover 200 may be provided with an inwardly and downwardly slanting top surface 2002. The sliding rectangular cover 200 can be slidable from the initial position to a release position against the spring force of the bow-shaped spring 201 when the one power cord plug C14, C20 of various types of power cord plugs is being inserted into the socket 100 and the protruded lateral side 110 is pressing on the slanting top surface 2002, as illustrated in FIG. 7.

In one embodiment, the sliding rectangular cover 200 may be provided with an inner edge or periphery 2003 at the central opening 2001. The sliding rectangular cover 200 can be slidable under the influence of the spring force of the bow-shaped spring 201 from the release position to an engaging position where the protruded lateral side 110 is located under and engageable with the inner periphery 2003 of the sliding rectangular cover 200, after the one power cord plug C14, C20 of various types of power cord plugs is completely inserted into the socket 100. This engagement can prevent the one power cord plug C14, C20 of various types of power cord plugs from being pulled out of the socket or becoming loose.

Figure 16C:
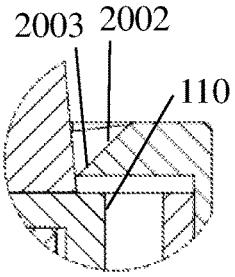
FIG. 16*c* is an enlarged view of the engagement of a protruded lateral side of the C14 plug with an inner periphery of the sliding rectangular cover according to an embodiment of the present disclosure.
Figure 16B:
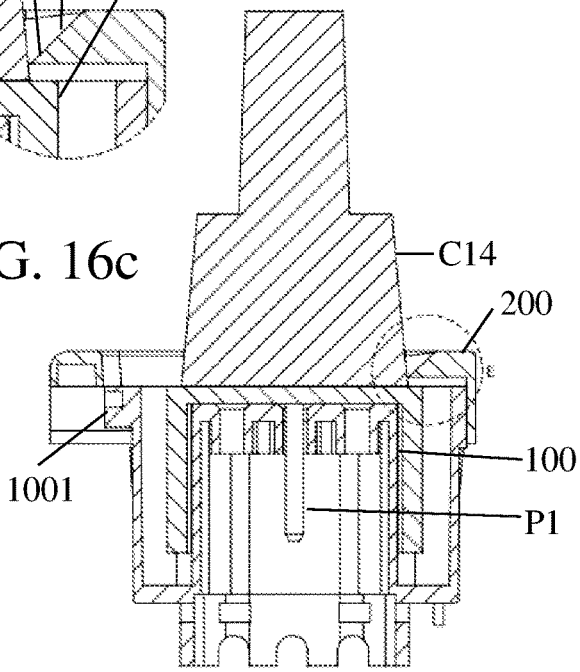
FIG. 16*b* is a cross sectional view of a C14 plug inserted into the socket with the sliding rectangular cover in an engaging position according to an embodiment of the present disclosure.
Figure 16A:
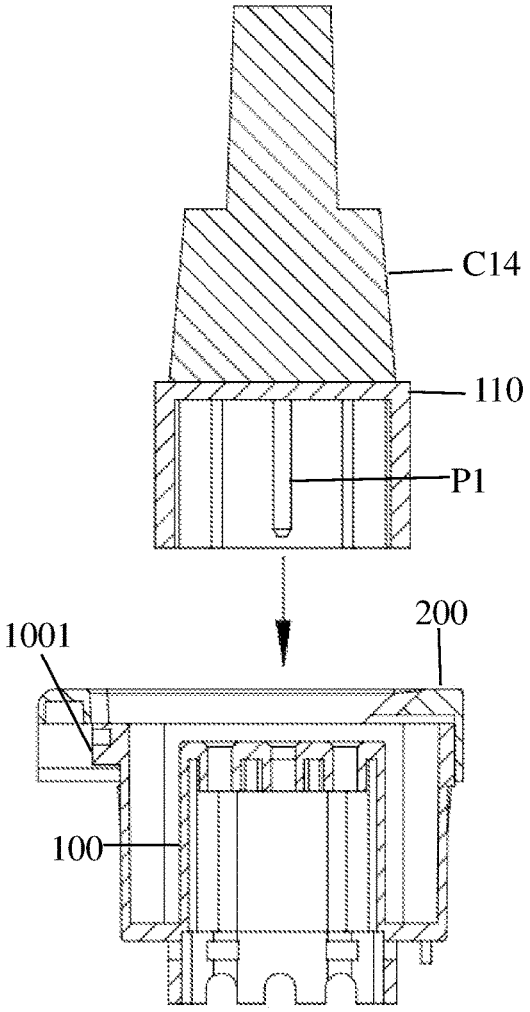
FIG. 16*a* is a cross sectional view of a C14 plug arranged in a position ready to be inserted into the socket with the sliding rectangular cover in an initial position according to an embodiment of the present disclosure.
Figure 16D:
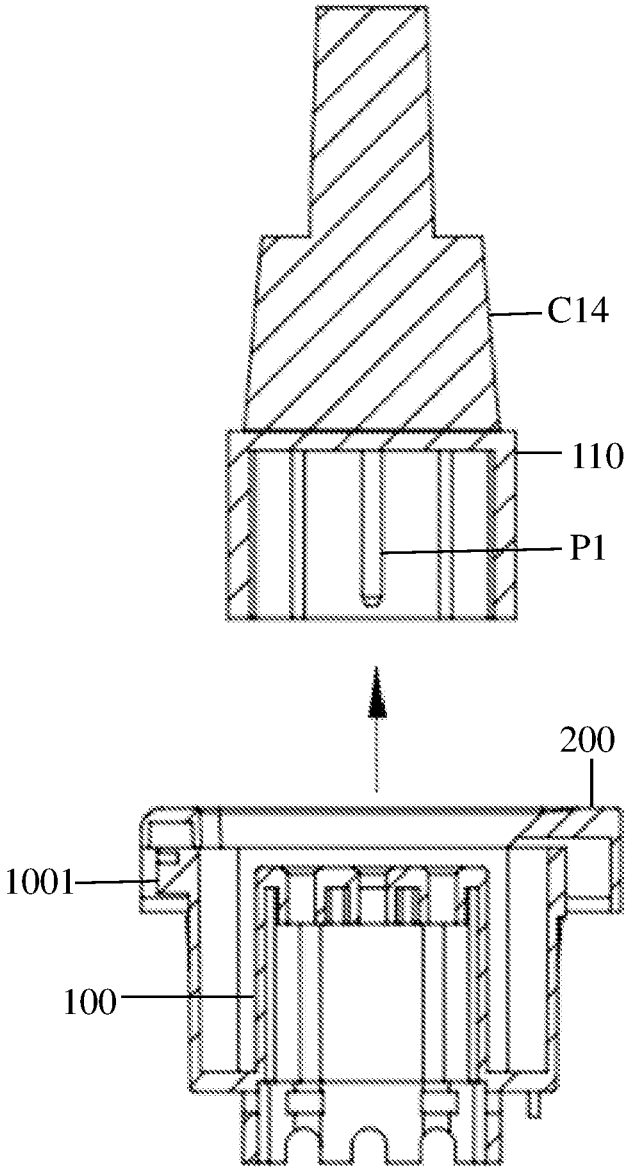
FIG. 16*d* is a cross sectional view of the sliding rectangular cover in a release position allowing the C14 plug to be pulled out from the socket according to an embodiment of the present disclosure.
Figure 17C:
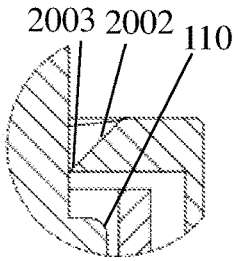
FIG. 17*c* is an enlarged view showing the engagement of a protruded lateral side of the C20 plug with an inner periphery of the sliding rectangular cover according to an embodiment of the present disclosure.
Figure 17B:
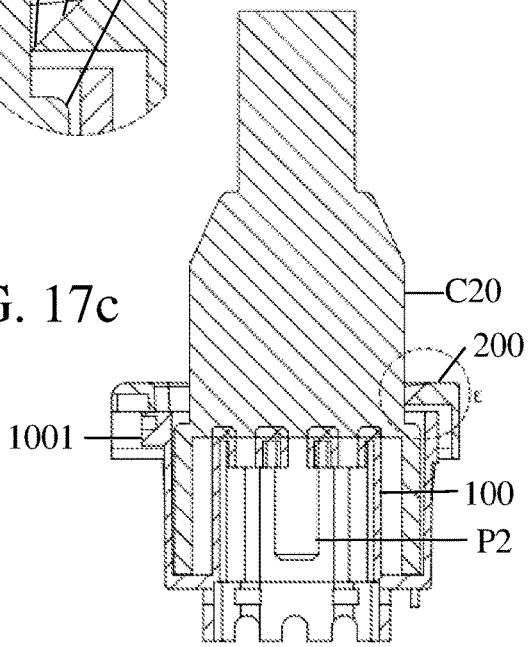
FIG. 17*b* is a cross sectional view of a C20 plug inserted into the socket with the sliding rectangular cover in an engaging position according to an embodiment of the present disclosure.
Figure 17A:
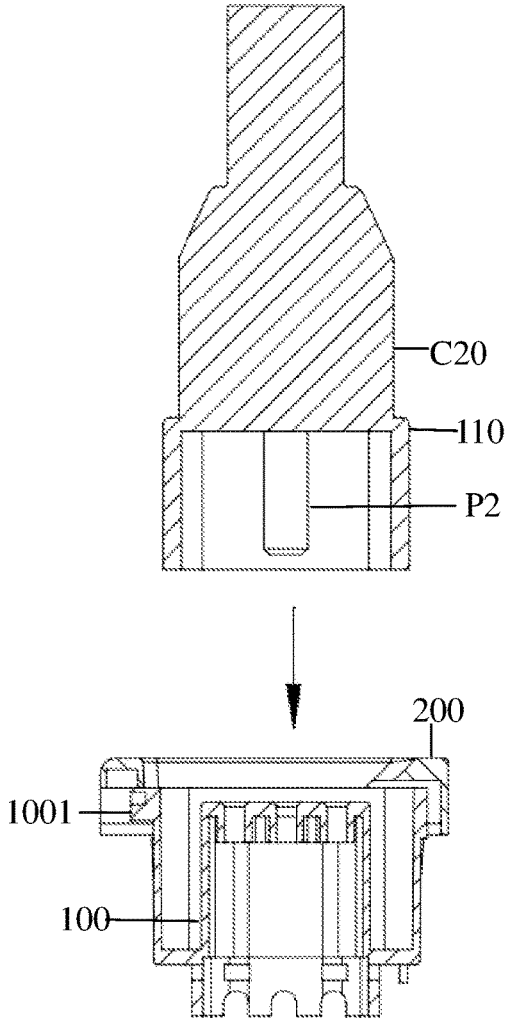
FIG. 17*a* is a cross sectional view of a C20 plug arranged in a position ready to be inserted into the socket with the sliding rectangular cover in an initial position according to an embodiment of the present disclosure.
Figure 17D:
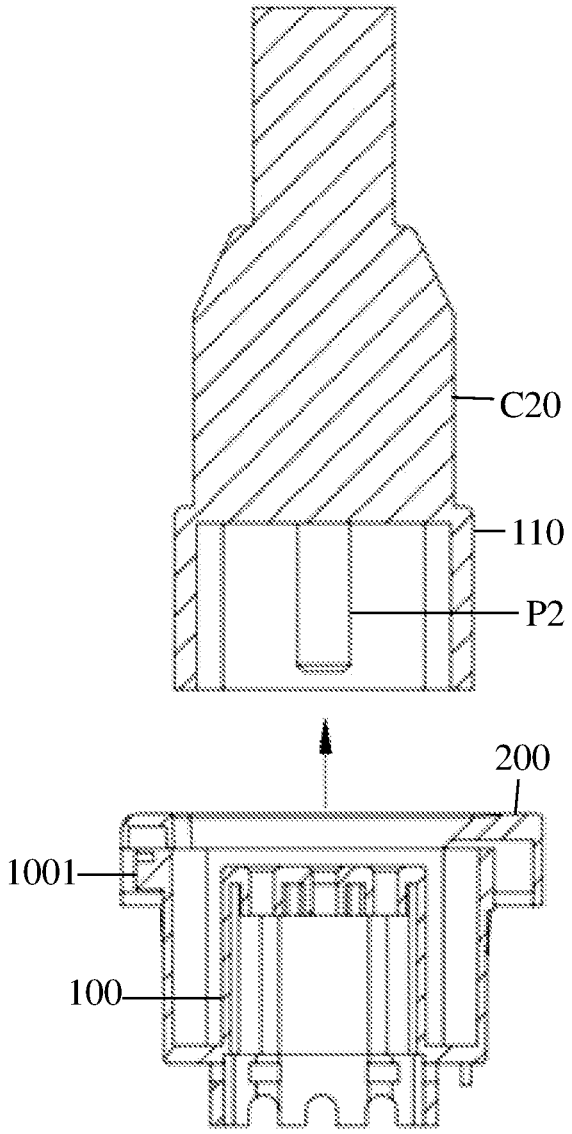
FIG. 17*d* is a cross sectional view of the sliding rectangular cover in a release position allowing the C20 plug to be pulled out from the socket according to an embodiment of the present disclosure.

The sliding rectangular cover 200 can be manually slidable by a user from the engaging position to the release position, as shown in FIGS. 16*d* and 17*d*, thereby allowing the one power cord plug C14, C20 of various types of power cord plugs to be pulled out of the socket 100.

Finally, the sliding rectangular cover 200 is automatically slidable from the release position back to the initial position under the influence of the spring force of the bow-shaped spring 201 after the one power cord plug C14, C20 of various types of power cord plugs is pulled out of the socket 100.

A cover 203 may be connected to one side of the outer casing 1001 of the socket 100 to form a compartment for receiving the bow-shaped spring 201.

The power outlet module 12 may further include a display unit 204. The display unit 204 may include a first light pipe 2041 mounted on the outer casing 1001 of the socket 100, and a second light pipe 2042 mounted on the sliding rectangular cover 200.

The first light pipe 2041 may have an inner end facing a light emitting diode 404 mounted on an electronic board 400 (see FIG. 15), and an outer end fitted within a first opening 1003 formed on the outer casing 1001 of the socket 100. The second light pipe 2042 may have an inner end abutting against the outer end of the first light pipe 2041, and an outer end fitted within a second opening 2005 provided on the sliding rectangular cover 200.

The second light pipe 2042 can be slidable on the outer end of the first light pipe 2041 when the sliding rectangular cover 200 slides along the outer casing 1001 of the socket 100. That is, an inner end surface of the inner end of the second light pipe 2042 may be abutting against and slidable along an outer end surface of the outer end of the first light pipe 2041. The outer end surface of the outer end of the first light pipe 2041 may be in flush with an outer surface of the outer casing 1001 of the socket 100. Light emitting from the light emitting diode 404 can be transmittable to an outer end surface of the outer end of the second light pipe 2042 through the first light pipe 2041 to display the power status of the socket 100.

In the illustrated embodiment, the first and second light pipes 2041, 2042 may be rectangular in shape and have a rectangular cross section. The width of the second light pipe 2042 may be smaller than the width of the first light pipe 2041 so that light can be transmitted to the outer end of the second light pipe 2042 whether the sliding rectangular cover 200 is in an initial position or slid to another position along the outer casing 1001 of the socket 100.

It is understood that the protruded lateral side 110 may be provided only on one lateral side of the protective sheath of the C14/C20 plug that is facing the inner periphery 2003 of the sliding rectangular cover 200 when the C14/C20 plug is being inserted into the socket 100.

Figure 8:
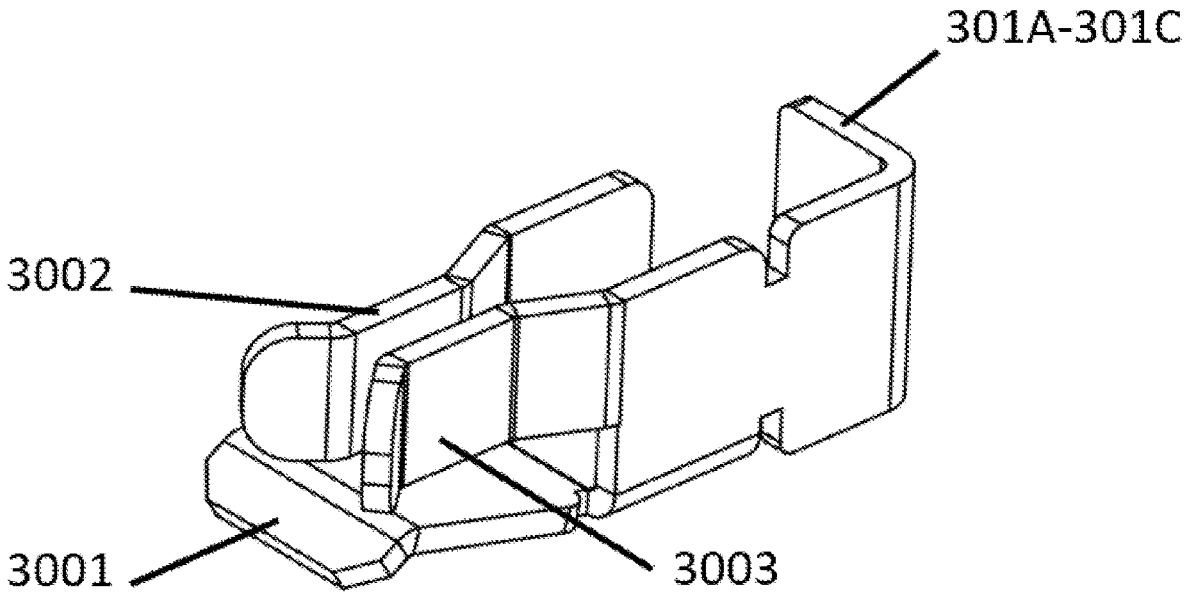
FIG. 8 is a perspective view of an electrical terminal of a socket according to an embodiment of the present disclosure.

FIG. 8 is a perspective view of an electrical terminal of the socket according to an embodiment of the present disclosure. Each of the electrical terminals 301A-301C is a combination of a C13 terminal and a C19 terminal. It is understood that terminal 301A can be a ground terminal, terminal 301B can be a neutral terminal, and terminal 301C can be a live terminal.

A C13 terminal portion of each electrical terminal 301A-301C can be connected to a flat pin of the C14 plug arranged in a vertical configuration, as shown in FIG. 1. The two flat surfaces of the flat pin of the C14 plug can be inserted between and in electrical contact with the two conductive strips 3002, 3003 of the electrical terminal 301A-301C. One side surface of the flat pin of the C14 plug can be abutted against and in electrical contact with the conductive strip 3001.

A C19 terminal portion of each electrical terminal 301A-301C can be connected to a flat pin of the C20 plug arranged in a horizontal configuration, as shown in FIG. 2. One flat surface of the flat pin of the C20 plug can be abutted against and in electrical contact with the inner side surfaces of the two conductive strips 3002, 3003 of the electrical terminal 301A-301C. An opposite flat surface of the flat pin of the C20 plug can be abutted against and in electrical contact with the conductive strip 3001.

Each of the electrical terminals 301A-301C may include a plurality of flexible conductive strip 3001-3003, which may be made of a flexible metal material, and pre-pressed to ensure that the conductive strips 3001-3003 can maintain contact with the pins of the C14 plug and the C20 plug.

Figure 9:
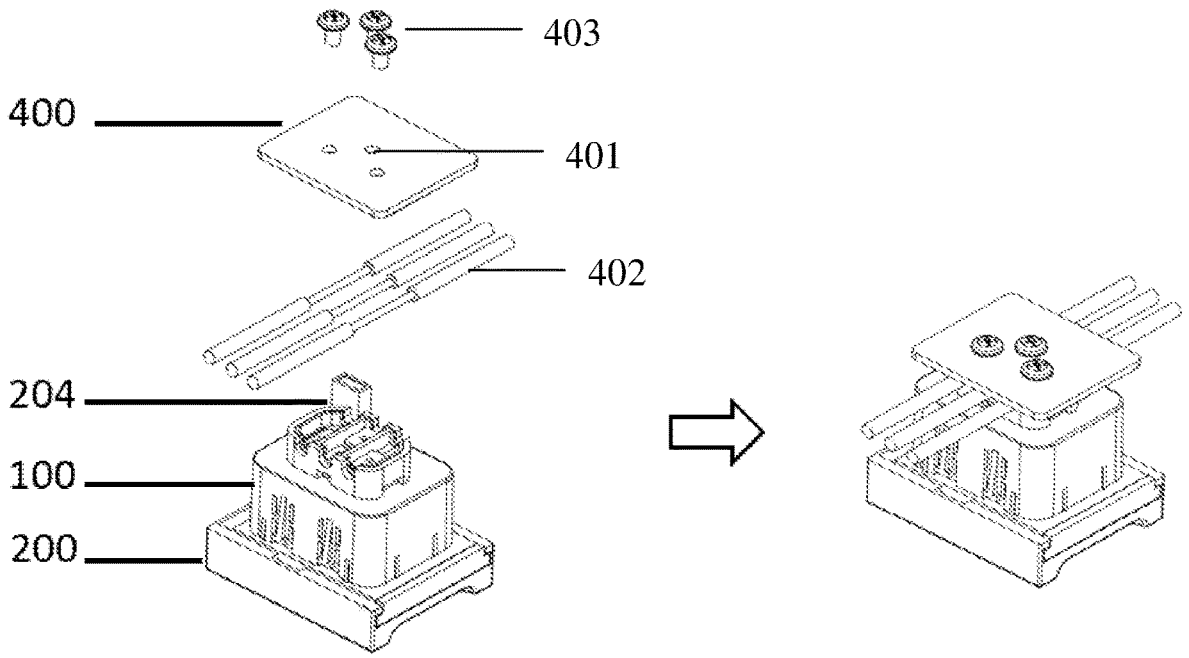
FIG. 9 shows a bottom view of the socket and the electrical terminals according to an embodiment of the present disclosure.

FIG. 9 shows the bottom of the socket 100 and the bottom of the electrical terminals 301A-301C according to an embodiment of the present disclosure. A bottom portion of each of the three electrical terminals 301A-301C may be connected and fastened to a power line 402 for power input by a screw 403 passing through a screw hole 401 formed on an electronic board 400. The bottom of the socket 100 may be formed with recesses in which the power lines 402 can be fixed. The bottom portion of the three electrical terminals 301A-301C may be connected with the electronic board 400 which is configured to detect power status of the three electrical terminals 301A-301C.

In the illustrated embodiment, the electronic board 400 may have three screw holes 401 for three screws 403 to directly contact with the bottom portion of the electrical terminals 301A-301C, and to lock the electronic board 400 and the power lines 402 at the bottom of the socket 100. Light signals showing the power status of the electrical terminals 301A-301C can be generated by the electronic board 400. The power status can be displayed by the light 2041 on the display unit 204 attached to the sliding rectangular cover 200.

Figure 10A:
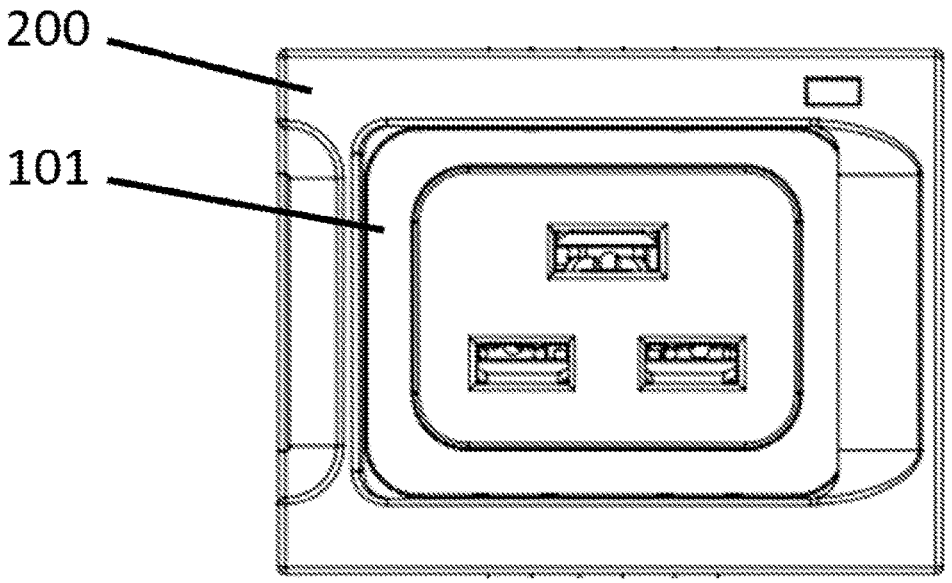
FIG. 10*a* is a front view of a power outlet module configured to connect only to a C20 plug according to an embodiment of the present disclosure.
Figure 10B:
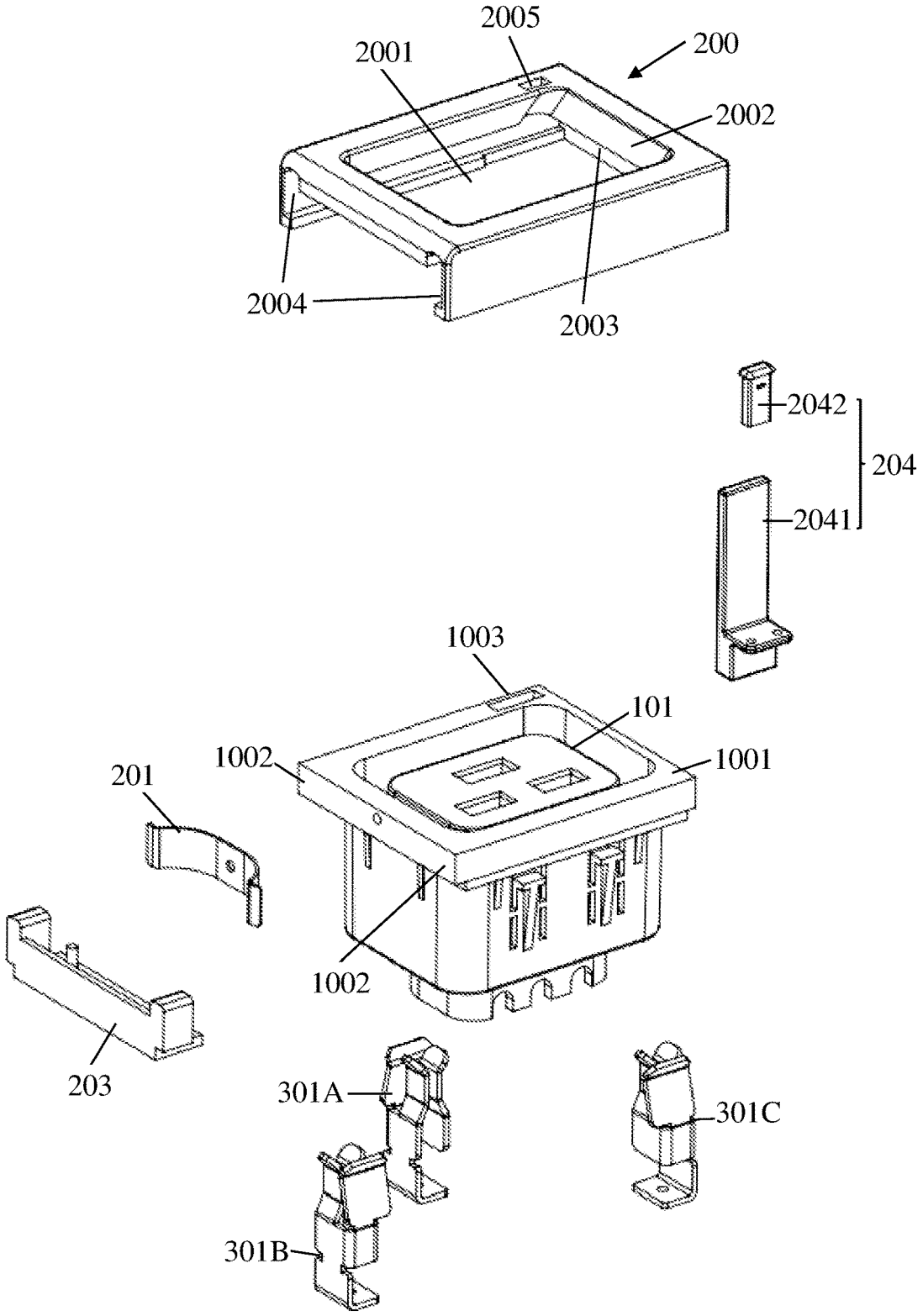
FIG. 10*b* is an exploded view of the power outlet module of FIG. 10*a* according to an embodiment of the present disclosure.

FIG. 10*a* is a front view of a power outlet module configured to connect only to a C20 plug according to an embodiment of the present disclosure, and FIG. 10*b* is an exploded view of the power outlet module of FIG. 10*a* according to an embodiment of the present disclosure.

In another embodiment, the plurality of power outlet modules 12 may further include at least one additional power outlet module having an additional socket 101 configured to connect only with a C20 plug. The additional socket 101 may include at least three electrical terminals, and the at least three electrical terminals of the additional socket 101 are configured to connect only with the pins of a C20 plug.

Figure 11A:
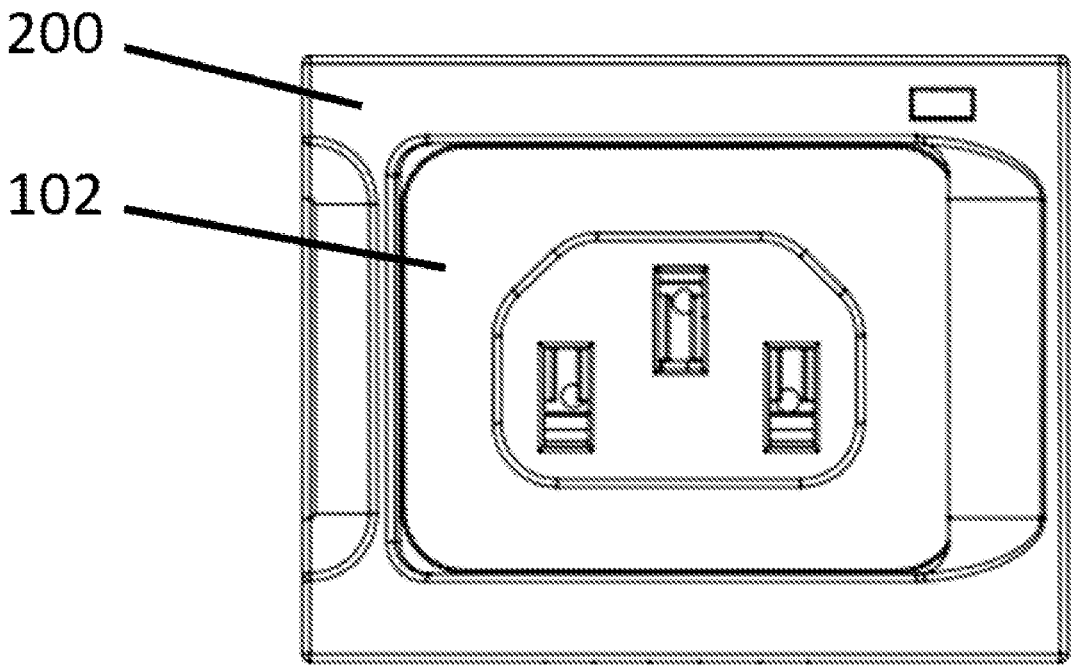
FIG. 11*a* is a front view of a power outlet module configured to connect only to a C14 plug according to an embodiment of the present disclosure.
Figure 11B:
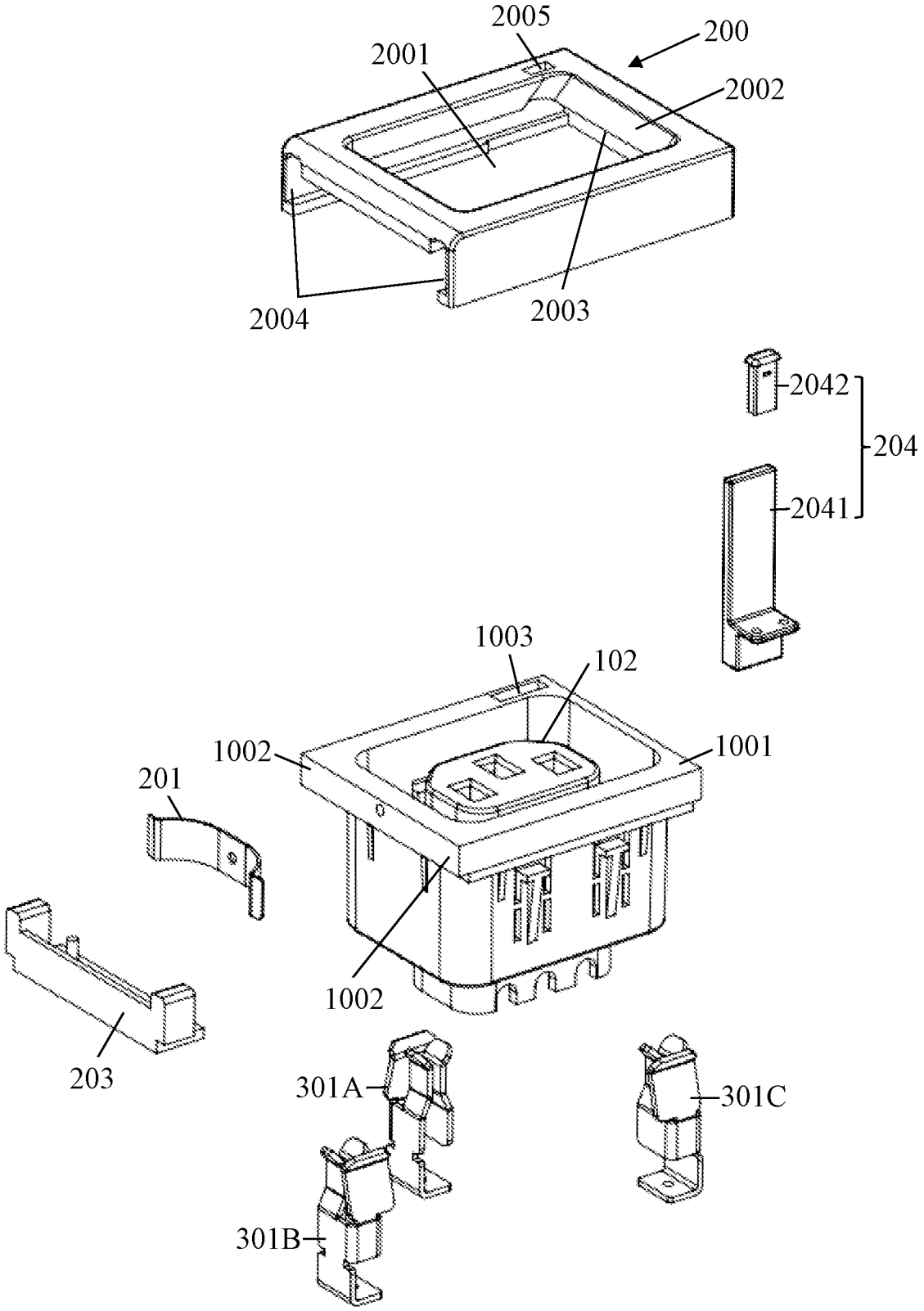
FIG. 11*b* is an exploded view of the power outlet module of FIG. 11*a* according to an embodiment of the present disclosure.

FIG. 11*a* is a front view of a power outlet module configured to connect only to a C14 plug according to an embodiment of the present disclosure, and FIG. 11*b* is an exploded view of the power outlet module of FIG. 11*a* according to an embodiment of the present disclosure.

In a further embodiment, the plurality of power outlet modules 12 may further include at least one additional power outlet module having an additional socket 102 configured to connect only with a C14 plug. The additional socket 102 may include at least three electrical terminals, and the at least three electrical terminals of the additional socket 102 are configured to connect only with the pins of a C14 plug.

Figure 12A:
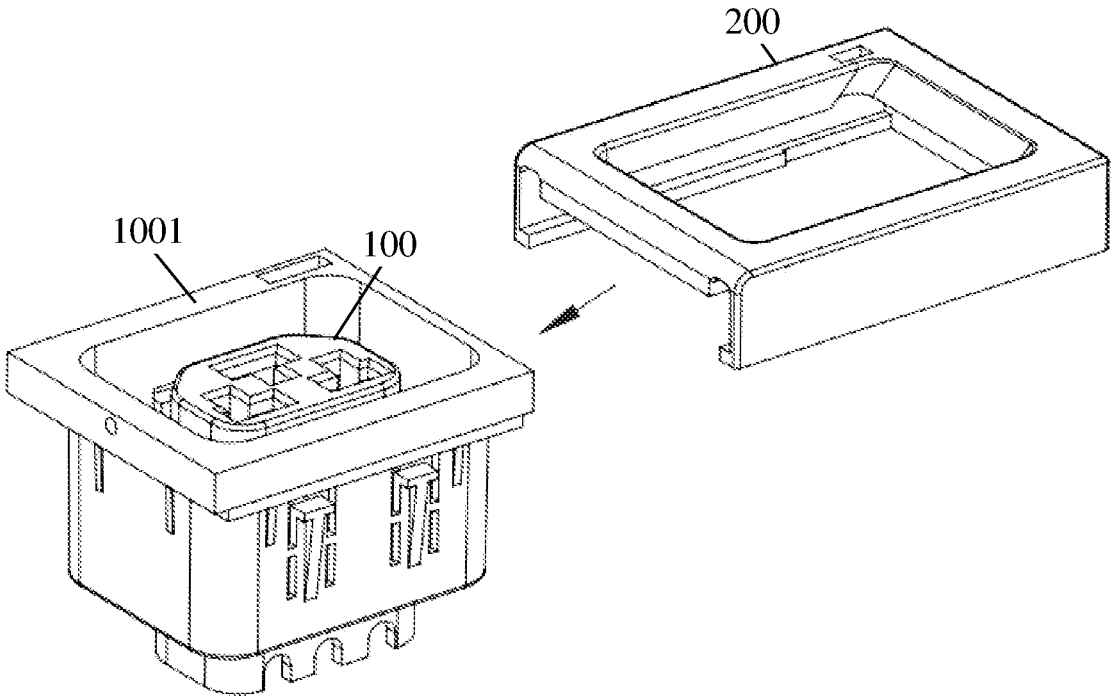
FIG. 12*a* is a perspective view showing the sliding connection of the sliding rectangular cover and the socket according to an embodiment of the present disclosure.
Figure 12B:
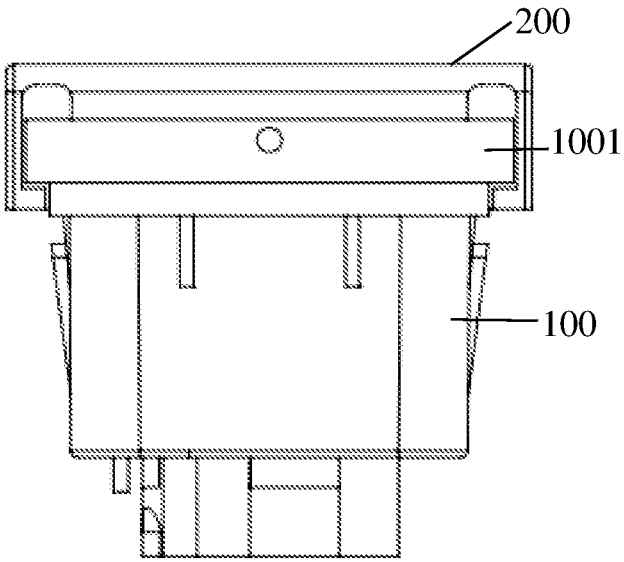
FIG. 12*b* is a side view of the sliding connection of the sliding rectangular cover and the socket of FIG. 12*a* according to an embodiment of the present disclosure.

FIG. 12*a* shows the sliding connection of the sliding rectangular cover 200 and the socket 100 according to an embodiment of the present disclosure. The sliding rectangular cover 200 can be slidable back and forth along a longitudinal axis of the outer casing 1001 of the socket 100. FIG. 12*b* is a side view of the sliding connection of the sliding rectangular cover 200 and the socket 100.

Figure 13B:
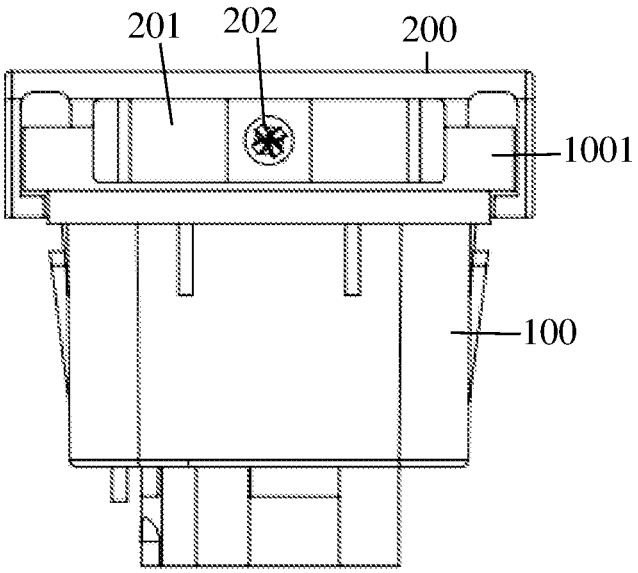
FIG. 13*b* is a side view of the connection of the bow-shaped spring to an outer casing of the socket of FIG. 13*a* according to an embodiment of the present disclosure.

FIG. 13*a* shows the attachment of the flexible bow-shaped spring 201 to an outer surface of the outer casing 1001 of the socket 100 according to an embodiment of the present disclosure. The use of only one piece of bow-shaped spring in a power outlet module can result in a module that is simple in structure, easy to assemble, and low in manufacturing cost. Furthermore, the spring force of a single bow-shaped spring is more balanced and reliable. FIG. 13*b* is a side view of the attachment of the flexible bow-shaped spring 201 to an outer surface of the outer casing 1001 of the socket 100.

Figure 14B:
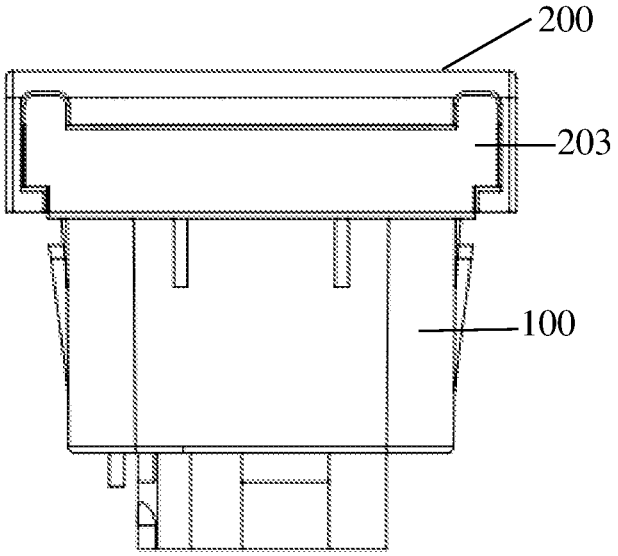
FIG. 14*b* is a side view of the connection of the cover to an outer casing of the socket of FIG. 14*a* according to an embodiment of the present disclosure.

FIG. 14*a* shows the connection of the cover 203 to the outer casing 1001 of the socket 100 according to an embodiment of the present disclosure. The cover 203 covers the bow-shaped spring 201 and forms a compartment having a sufficient space for the two flexible ends of the bow-shaped spring 201 to flex. FIG. 14*b* is a side view showing the attachment of the cover 203 to the outer casing 1001 of the socket 100.

Figure 15:
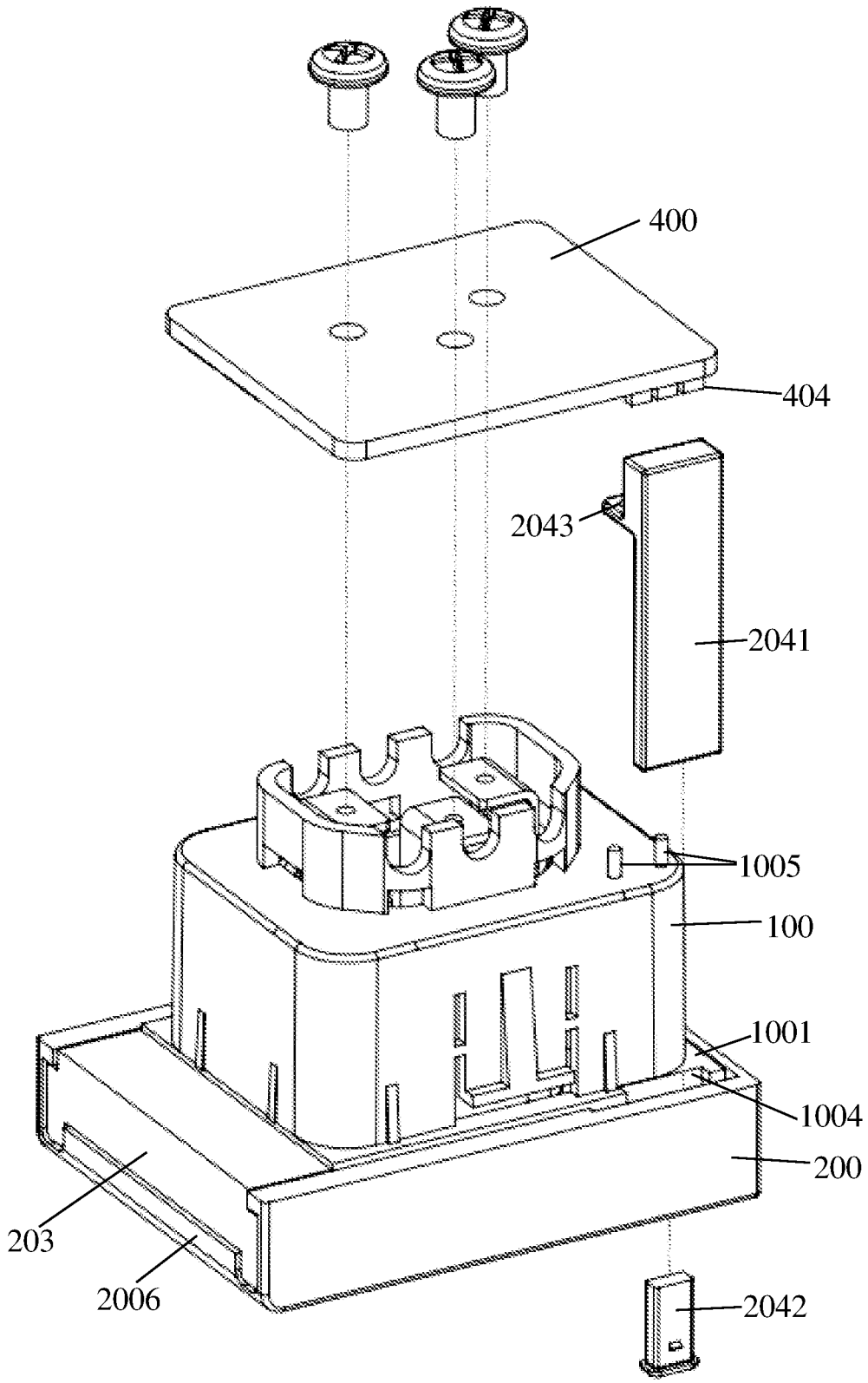
FIG. 15 is a bottom perspective view showing the connection of two light pipes to the socket and the sliding rectangular cover according to an embodiment of the present disclosure.

FIG. 15 shows the connection of the first and second light pipes 2041, 2042 to the socket 100 and the sliding rectangular cover 200 respectively according to an embodiment of the present disclosure. It can be seen that the outer end portion of the first light pipe 2041 may be fitted within a groove 1004 formed on the outer casing 1001 of the socket 100. The inner end portion of the first light pipe 2041 may be attached to an inner portion of the socket 100 by means of pins 1005 provided on the socket 100, and pin holes 2043 provided on the first light pipe 2041 for receiving the pins 1005. The first light pipe 2041 can be fixedly mounted in the second opening 2005 provided on the sliding rectangular cover 200.

FIG. 16*a* shows a C14 plug located in a position ready to be inserted into the socket 100, and the sliding rectangular cover 200 in an initial position where one side of the sliding rectangular cover 200 is urged against one side of the outer casing 1001 of the socket 100 by the bow-shaped spring 201 connecting between the sliding rectangular cover 200 and the outer casing 1001 of the socket 100, and FIG. 16*b* shows the C14 plug inserted into the socket 100 and the sliding rectangular cover 200 in an engaging position according to an embodiment of the present disclosure.

As best illustrated in the enlarged view in FIG. 16*c*, after the C14 plug is completely inserted into the socket 100, and the protruded lateral side 110 of the C14 plug passes the inner periphery 2003 of the sliding rectangular cover 200, the sliding rectangular cover 200 is slidable under the influence of the spring force of the bow-shaped spring 201 from a release position to the engaging position where the protruded lateral side 110 of the C14 plug is located under the inner periphery 2003 of the sliding rectangular cover 200, and the inner periphery 2003 of the sliding rectangular cover 200 is abutting against a lateral side of the C14 plug. In this engaging position, a secure socket-and-plug connection can be formed between the C14 plug and the socket 100. This can prevent the C14 plug from becoming loose, or being disconnected unintentionally when a pulling force acts on the plug in a direction away from the socket 100. This can also prevent the socket 100 from being damaged or burnt. As a result, the chance of a fire hazard can be reduced, and the product life of the socket and/or the plug can be extended.

FIG. 16*d* shows the sliding rectangular cover 200 located in a release position. The sliding rectangular cover 200 can be manually pulled sideways against the spring force of the bow-shaped spring 201 to the release position, thereby allowing the C14 plug to be pulled out from the socket 100.

Similarly to a C14 plug, FIG. 17*a* shows a C20 plug located in a position ready to be inserted into the socket 100 and the sliding rectangular cover 200 in an initial position, and FIG. 17*b* shows the C20 plug inserted into the socket 100 and the sliding rectangular cover 200 in an engaging position according to an embodiment of the present disclosure. FIG. 17*c* is an enlarged view of the engagement of the protruded lateral side 110 of the C20 plug with the inner periphery 2003 of the sliding rectangular cover 200. FIG. 17*d* shows the sliding rectangular cover 200 located in a release position. The sliding rectangular cover 200 can be manually pulled sideways against the spring force of the bow-shaped spring 201 to the release position, thereby allowing the C20 plug to be pulled out from the socket 100.

Figure 18B:
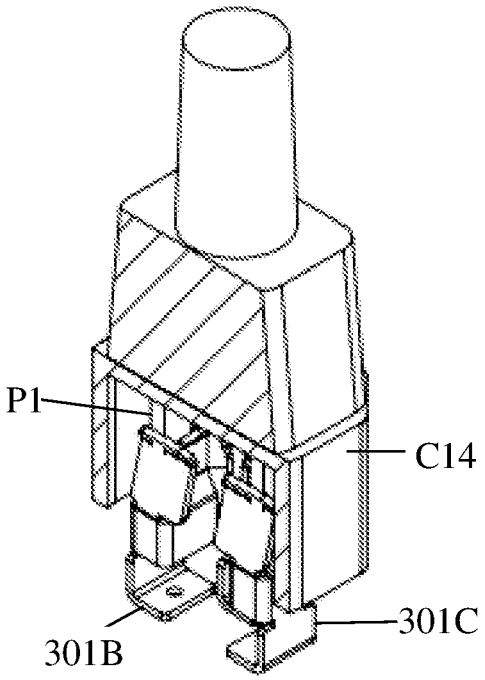
FIG. 18*b* is a cutaway perspective view of the C14 plug with three pins respectively connected to the three electrical terminals of the socket of FIG. 18*a* according to an embodiment of the present disclosure.
Figure 18A:
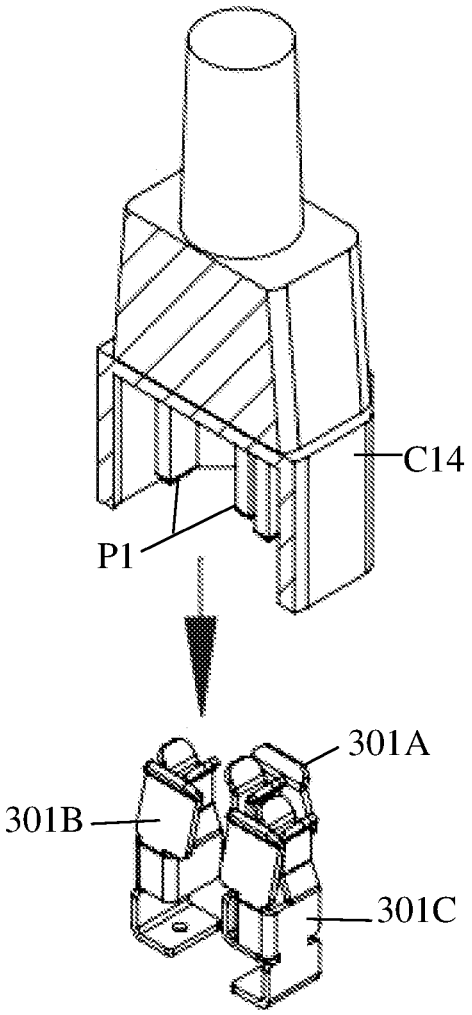
FIG. 18*a* is a cutaway perspective view of a C14 plug with three pins arranged in a position ready to be connected to three electrical terminals of the socket according to an embodiment of the present disclosure.

FIG. 18*a* shows a C14 plug with three pins P1 that are arranged in a position ready to be connected to the three electrical terminals 301A-301C of the socket 100, and FIG. 18*b* shows the C14 plug with three pins P1 that are respectively connected to the three electrical terminals 301A-301C according to an embodiment of the present disclosure.

Figure 19B:
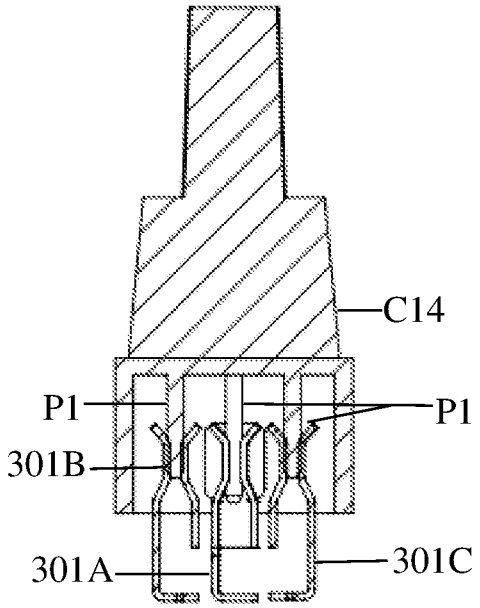
FIG. 19*b* is a cross sectional view of the C14 plug with three pins respectively connected to the three electrical terminals of the socket of FIG. 19*a* according to an embodiment of the present disclosure.
Figure 19A:
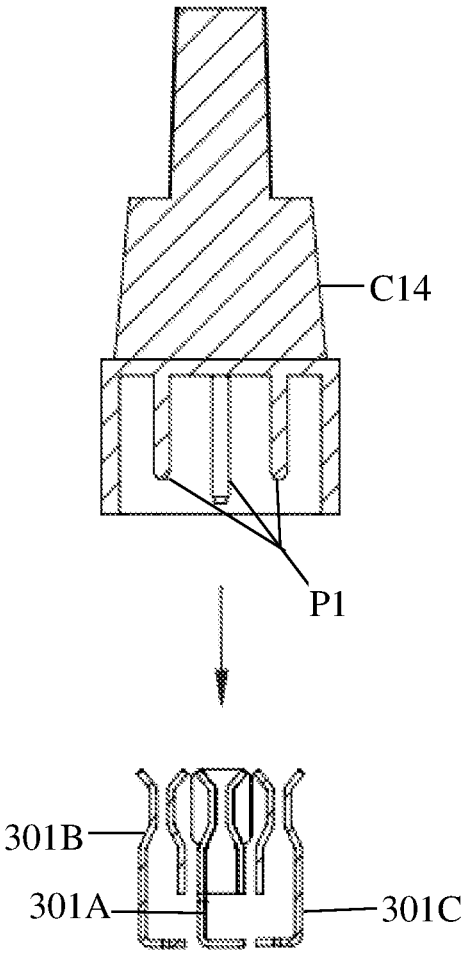
FIG. 19*a* is a cross sectional view of a C14 plug with three pins arranged in a position ready to be connected to three electrical terminals of the socket according to an embodiment of the present disclosure.

From a different view, FIG. 19*a* is a cross sectional view of the C14 plug with three pins P1 being arranged in a position ready to be connected to the three electrical terminals 301A-301C of the socket 100, and FIG. 19*b* is a cross sectional view of the C14 plug with three pins P1 that are respectively connected to the three electrical terminals 301A-301C according to an embodiment of the present disclosure.

Figure 20B:
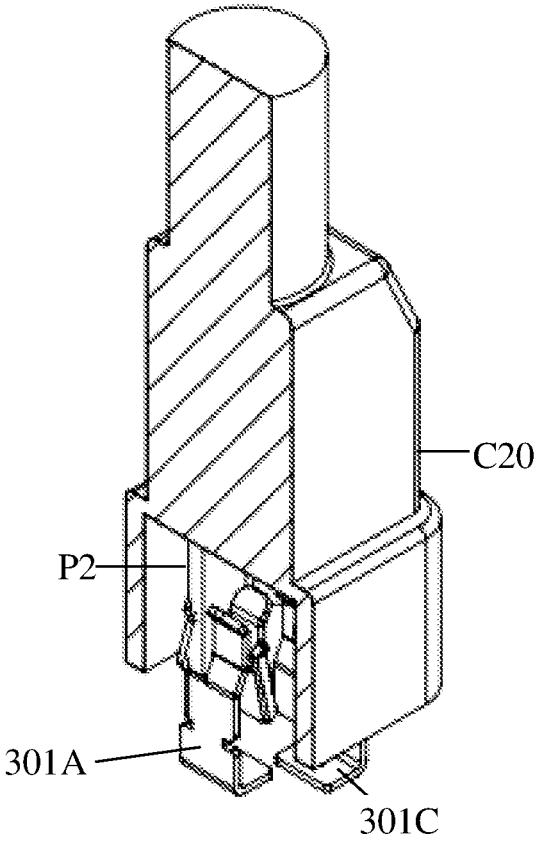
FIG. 20*b* is a cutaway perspective view of the C20 plug with two of the three pins respectively connected to two of the three electrical terminals of the socket of FIG. 20*a* according to an embodiment of the present disclosure.
Figure 20A:
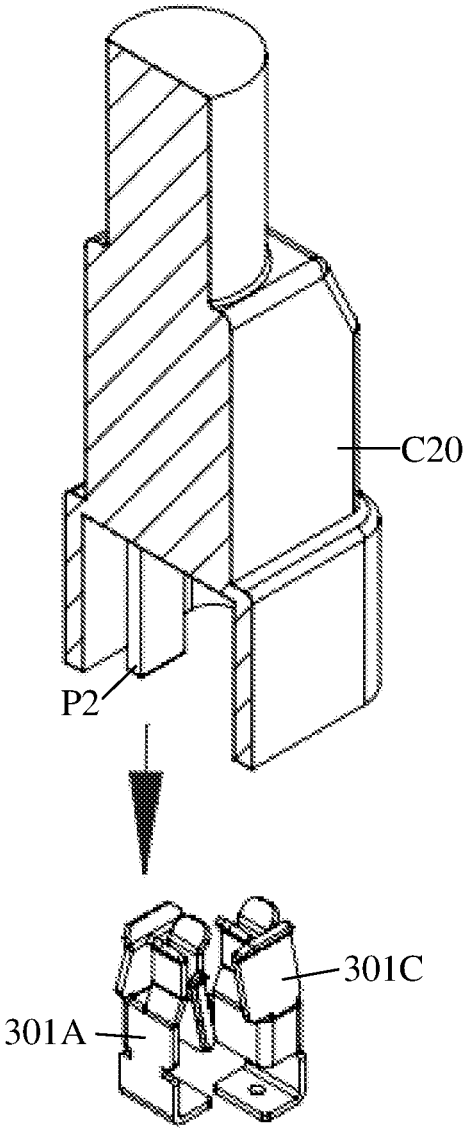
FIG. 20*a* is a cutaway perspective view of a C20 plug with two of the three pins in a position ready to be connected to two of the three electrical terminals of the socket according to an embodiment of the present disclosure.

Similarly to a C14 plug, FIG. 20*a* shows a C20 plug with two (one being covered by the protective shield of the plug) of the three pins P2 that are arranged in a position ready to be connected to two the three electrical terminals 301A-301C of the socket 100. For clarity purposes, the third pin of the C20 plug and the third electrical terminal of the socket 100 are not shown. FIG. 20*b* shows the C20 plug with two (one being covered by the protective shield of the plug) of the three pins P2 that are respectively connected to two of the three electrical terminals 301A-301C according to an embodiment of the present disclosure.

Figure 21B:
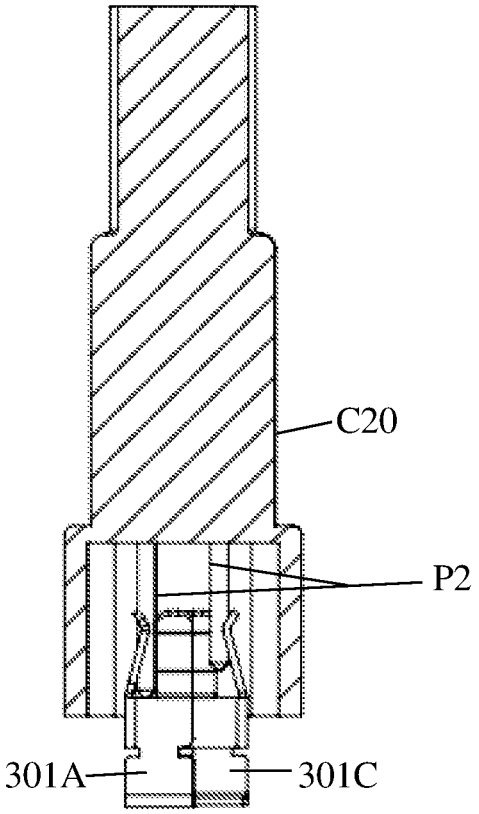
FIG. 21*b* is a cross sectional view of the C20 plug with two of the three pins respectively connected to two of the three electrical terminals of the socket of FIG. 21*a* according to an embodiment of the present disclosure.
Figure 21A:
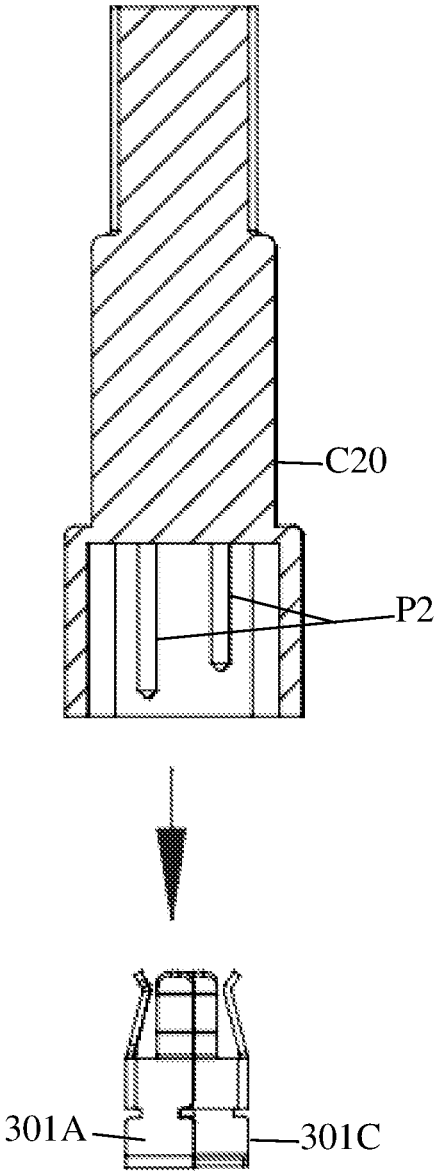
FIG. 21*a* is a cross sectional view of a C20 plug with two of the three pins in a position ready to be connected to two of the three electrical terminals of the socket according to an embodiment of the present disclosure.

From a different view, FIG. 21*a* is a cross sectional view of the C20 plug with two of the three pins P2 being arranged in a position ready to be connected to two of the three electrical terminals 301A-301C of the socket 100, and FIG. 21*b* is a cross sectional view of the C20 plug with two of the three pins P2 that are respectively connected to two of the three electrical terminals 301A-301C of the socket 100 of FIG. 19*a* according to an embodiment of the present disclosure.

It is believed that the present disclosure and its many advantages will be understood and apparent from the foregoing description without departing from the disclosed subject matter or sacrificing all material advantages thereof. The ways of description are merely illustrative and the appended claims are intended to include and cover such modifications.

What is claimed is:

1. A power distribution unit, comprising:

a housing;

a plurality of power outlet modules accommodated in the housing, at least one of the plurality of power outlet modules comprising:

a socket, the socket having at least three electrical terminals, the at least three electrical terminals being configured to connect with one power cord plug of various types of power cord plugs, the various types of power cord plugs including a C14 plug and a C20 plug, and a sliding cover having a central opening, the sliding cover being slidable on an outer casing of the socket, and engageable with the one power cord plug of various types of power cord plugs when the one power cord plug of various types of power cord plugs is completely inserted into the socket, thereby providing a secure connection between the socket and the one power cord plug of various types of power cord plugs; and at least one power input module connected with and providing power to the plurality of power outlet module, wherein a protruded lateral side is provided on a protective shield located at a free end of the one power cord plug of various types of power cord plugs; wherein a spring mechanism is connecting between the sliding cover and the outer casing of the socket for holding the sliding cover in an initial position; and the sliding cover is provided with an inwardly and downwardly slanting top surface, and the sliding cover is slidable from the initial position to a release position against a biasing force of the spring mechanism when the one power cord plug of various types of power cord plugs is being inserted into the socket, and the protruded lateral side is pressing on the inwardly and downwardly slanting top surface.

2. The power distribution unit according to claim 1, wherein the sliding cover is provided with an inner periphery at the central opening, and the sliding cover is slidable under influence of a spring force of the spring mechanism from the release position to an engaging position where the protruded lateral side is located under and engaged with the inner periphery of the sliding cover, after the one power cord plug of various types of power cord plugs is completely inserted into the socket, thereby preventing the one power cord plug of various types of power cord plugs from being pulled out of the socket or becoming loose.

3. The power distribution unit according to claim 2, wherein the sliding cover is adapted to be manually slidable by a user from the engaging position to the release position, thereby allowing the one power cord plug of various types of power cord plugs to be pulled out of the socket.

4. The power distribution unit according to claim 3, wherein the sliding cover is adapted to be automatically slidable from the release position to the initial position under the influence of the spring force of the spring mechanism after the one power cord plug of various types of power cord plugs is pulled out of the socket.

5. The power distribution unit according to claim 1, wherein each electrical terminal of the at least three electrical terminals is configured to connect with a pin of the C14 plug or a pin of the C20 plug.

6. The power distribution unit according to claim 1, wherein each electrical terminal of the at least three electrical terminals comprises a plurality of flexible conductive strips configured to hold and make electrical contact with a pin of the C14 plug or a pin of the C20 plug.

7. The power distribution unit according to claim 1, wherein the plurality of power outlet modules further includes at least one additional power outlet module comprising an additional socket configured to connect only with the C14 plug.

8. The power distribution unit according to claim 1, wherein the plurality of power outlet modules further includes at least one additional power outlet module comprising an additional socket configured to connect only with the C20 plug.

9. The power distribution unit according to claim 7, wherein the additional socket includes at least three electrical terminals, the at least three electrical terminals of the additional socket being configured to connect only with the C14 plug.

10. The power distribution unit according to claim 8, wherein the additional socket includes at least three electrical terminals, the at least three electrical terminals of the additional socket being configured to connect only with the C20 plug.

11. The power distribution unit according to claim 1, wherein a bottom portion of each of the at least three electrical terminals is connected and fastened to a power line by a screw.

12. The power distribution unit according to claim 1, wherein bottom portions of the at least three electrical terminals are connected with an electronic board configured to detect power status of the at least three electrical terminals.

13. The power distribution unit according to claim 12, wherein each of the plurality of power outlet modules further comprises a display unit, the display unit comprising:

a first light pipe mounted on the outer casing of the socket, the first light pipe having an inner end facing a light emitting diode mounted on the electronic board, and an outer end fitted within a first opening provided on the outer casing of the socket; and a second light pipe mounted on the sliding cover, the second light pipe having an inner end abutting against the outer end of the first light pipe, and an outer end fitted within a second opening provided on the sliding cover, the second light pipe being slidable on the outer end of the first light pipe when the sliding cover slides along the outer casing of the socket, whereby light emitting from the light emitting diode is transmittable to the outer end of the second light pipe through the first light pipe to display power status of the socket.

14. The power distribution unit according to claim 1, wherein different sliding covers comprised in the plurality of power outlet modules have different colors.

15. The power distribution unit according to claim 1, wherein the sliding cover is rectangular in shape.

16. The power distribution unit according to claim 1, wherein the spring mechanism comprises a flexible bow-shaped spring, a middle portion of the bow-shaped spring being fastened to an outer surface of one side of the outer casing of the socket by a fastener, and two flexible ends of the bow-shaped spring being abutted against an inner surface of a sidewall of the sliding cover.

17. A power outlet module with secure socket-and-plug connection, the power outlet module comprising:

a socket, the socket having at least three electrical terminals, the at least three electrical terminals being configured to connect with one power cord plug of various types of power cord plugs, the various types of power cord plugs including a C14 plug and a C20 plug;

a sliding cover having a central opening, the sliding cover being slidable on an outer casing of the socket, two elongated grooves being provided on two opposite sides of the sliding cover and in slidable engagement with two matching elongated projections provided on two opposite sides of the outer casing of the socket respectively; and a spring mechanism connecting between the sliding cover and the outer casing of the socket, wherein an inner periphery of the sliding cover is engageable with a protruded lateral side provided on a protective shield located at a free end of the one power cord plug of various types of power cord plugs when the one power cord plug of various types of power cord plugs is completely inserted into the socket, thereby providing a secure connection between the socket and the one power cord plug of various types of power cord plugs.

* * * * *